United States Patent [19]

Westergren

[11] Patent Number: 4,787,117

[45] Date of Patent: Nov. 29, 1988

[54] VACUUM CLEANER ELECTRICAL CONNECTOR MOUNT

[75] Inventor: George A. Westergren, Linwood Township, Anoka County, Minn.

[73] Assignee: Whirlpool Corporation, Benton Harbor, Mich.

[21] Appl. No.: 5,829

[22] Filed: Jan. 22, 1987

[51] Int. Cl.[4] ..... A47L 9/24

[52] U.S. Cl. ..... 15/339; 15/377; 174/47; 439/191; 439/607; 285/7

[58] Field of Search ..... 15/339, 377; 439/190, 439/191, 192, 607, 608; 285/7; 174/47; 361/215

[56] References Cited

U.S. PATENT DOCUMENTS

| | | | |
|---|---|---|---|
| 1,988,816 | 1/1935 | Smith | 174/47 |
| 3,082,394 | 3/1963 | Hahn et al. | 439/191 |
| 3,127,227 | 3/1964 | Edwards | 339/15 |
| 3,171,889 | 3/1965 | McCarthy | 174/47 |
| 3,327,049 | 6/1967 | Brown et al. | 174/47 |
| 3,546,656 | 12/1970 | Pritulsky | 439/191 |
| 3,553,629 | 1/1971 | Brown et al. | 339/15 |
| 3,658,248 | 4/1972 | Mann et al. | 339/44 |
| 3,961,647 | 6/1976 | Doubleday | 138/103 |
| 3,965,526 | 6/1976 | Doubleday | 15/377 |
| 4,063,790 | 12/1977 | Kleykamp et al. | 439/191 |
| 4,079,965 | 3/1978 | Moughty et al. | 174/47 |
| 4,094,535 | 6/1978 | Minton | 285/7 |
| 4,127,316 | 11/1978 | McKee et al. | 339/103 |
| 4,165,140 | 8/1979 | Lyman et al. | 339/15 |
| 4,183,603 | 1/1980 | Donarummo | 339/75 P |
| 4,188,081 | 2/1980 | Holden et al. | 339/15 |
| 4,211,457 | 7/1980 | Meadows | 339/15 |
| 4,283,594 | 8/1981 | Somers | 174/47 |
| 4,316,304 | 2/1982 | Parise et al. | 15/339 |
| 4,405,969 | 9/1983 | Swavely | 174/47 |
| 4,422,702 | 12/1983 | Nordeen | 339/15 |
| 4,494,270 | 1/1985 | Ritzau et al. | 15/377 |
| 4,618,195 | 10/1986 | Keane | 285/7 |
| 4,652,063 | 3/1987 | Genoa et al. | 174/47 |

FOREIGN PATENT DOCUMENTS 54-160061 12/1979 Japan .

*Primary Examiner*—Harvey C. Hornsby
*Assistant Examiner*—Corinne M. Reinckens
*Attorney, Agent, or Firm*—Wood, Dalton, Phillips Mason & Rowe

[57] ABSTRACT

A plug retainer for use in a vacuum cleaner having a handle removably connected to a wand. The plug retainer is arranged to effectively preclude discharge of static electricity from the dirty suction air to the electrical conductors and interconnected plugs so as to avoid spurious operation of electrostatic discharge sensitive control structure of the vacuum cleaner, which may include microprocessor control elements. The plug retainer structure includes a locking tongue and an integral static shield extending over a substantial area between the connected male and female plugs of the control wiring.

15 Claims, 1 Drawing Sheet

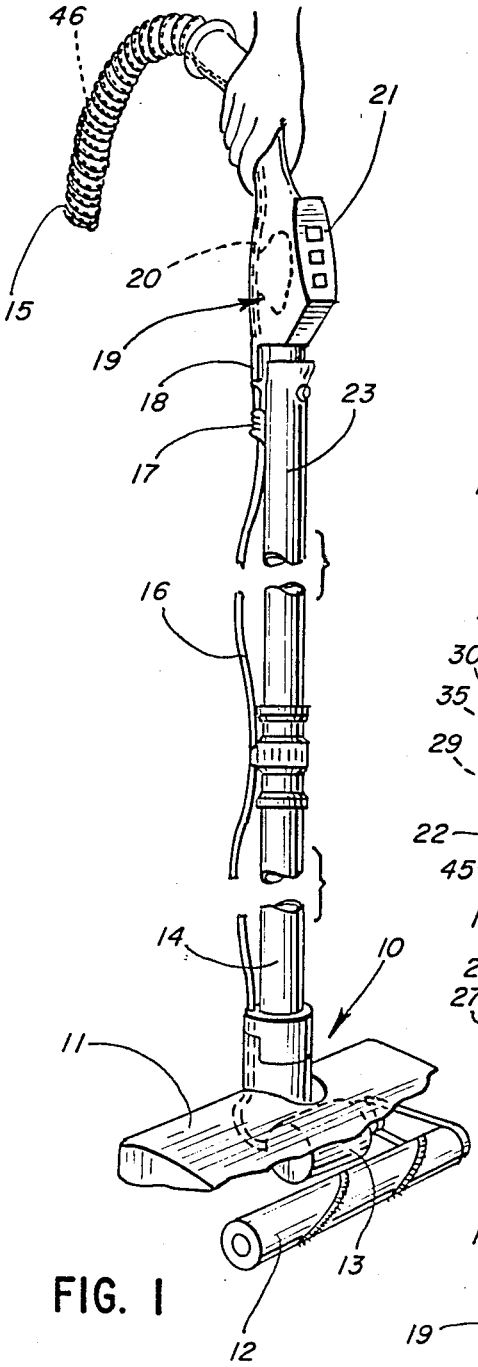
FIG. 1
FIG. 2
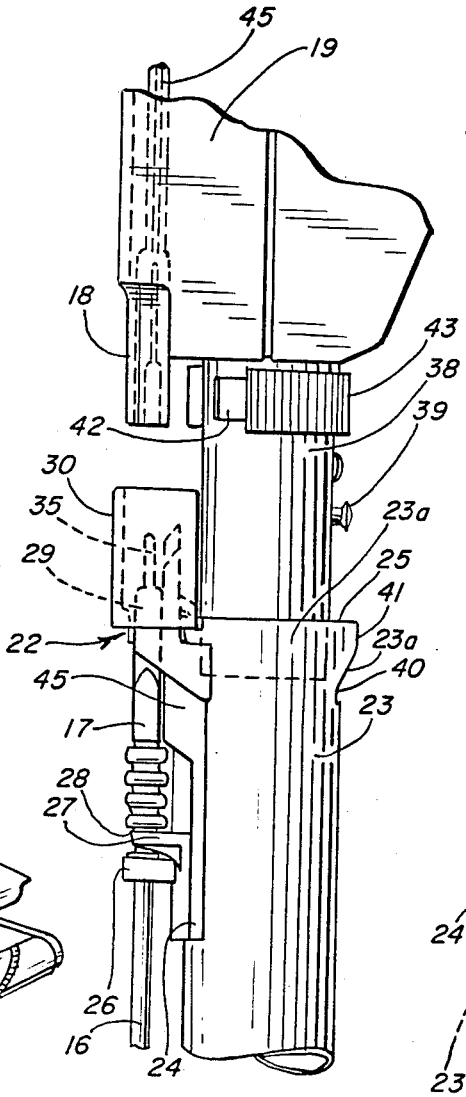
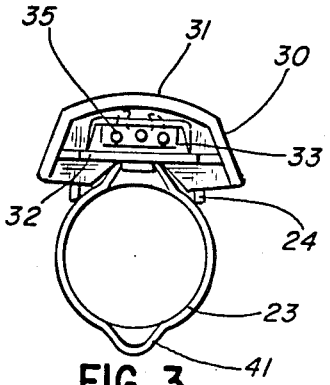
FIG. 3
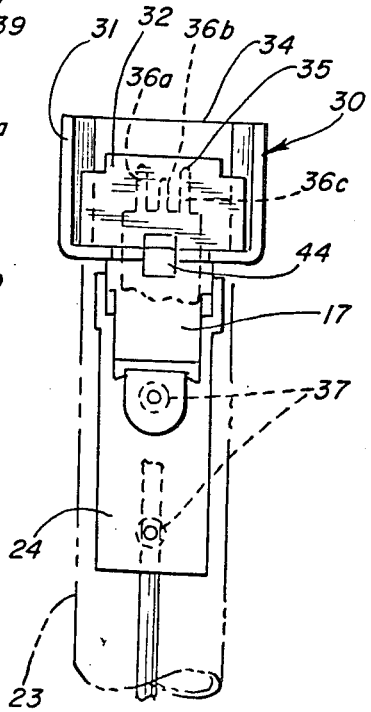
FIG. 4
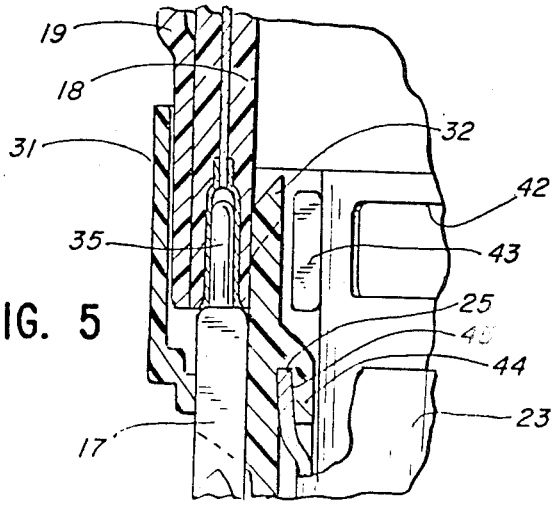
FIG. 5

VACUUM CLEANER ELECTRICAL CONNECTOR MOUNT

TECHNICAL FIELD

This invention relates to vacuum cleaners and in particular to means for mounting disconnectable electrical connectors therein.

BACKGROUND ART

In one form of vacuum cleaner, a suction nozzle is moved over the floor surface by means of a wand connected to the nozzle and a handle mounted to the upper end of the wand and connected through a hose to the suction unit of the vacuum cleaner, such as the canister portion thereof.

In one form of such vacuum cleaner, electrical power is provided to a brush motor mounted in the nozzle, through electrical conductors extending along the wand. The upper end of the wand conductors is provided with an electrical connector adapted to be removably connected to a complementary connector mounted to the handle. Electrical conductors are connected to the connector of the handle and extend through the hose to be electrically connected to the electrical power supply at a connection at the suction unit.

The present invention is concerned with means for mounting the electrical connector to the upper end of the wand.

One such electrical connector is illustrated in U.S. Pat. No. 4,422,702 of Irwin E. Nordeen, which patent is owned by the assignee hereof. As shown therein, the electrical connector comprises a plug having projecting male terminals adapted to be removably received in electrical connected association with the female plug 24 mounted to the handle of the suction hose. A plug housing is mounted to the wand and includes a base portion secured to the wand upper end, such as by rivets. The female connector is secured to the hose handle portion by a second housing.

Recently, microprocessor controls have been incorporated in the handle of such vacuum cleaner structures providing improved control of the operation of the vacuum cleaner. It has been found, however, that at times, false control signals are generated by the static electricity which builds up as a result of the flow of the soil particles through the wand and hose assembly. It has been found that such an electrostatic charge may, at times, reach a potential which is high enough to cause an electrostatic discharge, thereby providing spurious operation of the microprocessor control. A number of solutions to this vexatious problem have been attempted, but none has proven completely satisfactory. It has been found impractical and substantially not possible to eliminate the buildup of the static charge. Similarly, attempts to provide an increased insulation of the wire leads, so that the breakdown resistance exceeds the electrostatic charge potential, has been found to be impractical. This approach tends to cause the charge voltage to increase, thus exposing the user to a higher potential and, thus, would be undesirable.

Another solution has been to provide a static shield mounted to the plug retainer to prevent discharge of the electrostatic charge to the electrical conductors. The static shield devices of the prior art have not proven completely satisfactory, in that the electrostatic charges have discharged around the shield between the shield and retainer element.

DISCLOSURE OF INVENTION

The present invention comprehends an improved means for preventing generation of spurious signals in microprocessor components of a vacuum cleaner control, as a result of the generation of electrostatic charges developed therein.

More specifically, the invention comprehends the provision of a static shield integral with the plug retainer.

In the illustrated embodiment, an increased area of static shielding is provided for effectively preventing discharge of the electrostatic charge to the electrical conductors.

In the illustrated embodiment, the plug retainer includes an integral end tab for receiving the distal end of the wand, providing improved mounting of the retainer thereto and extending the electrostatic shielding.

The retainer provides increased air gap spacing and insulation between the insulation of the connector and the metal wall of the wand.

The retainer has improved strength as a result of the provision of the integral static shield, while at the same time providing effective shielding of the electrical conductors for effectively precluding spurious operation of associated solid state components, such as the microprocessor of the control.

The plug retainer having the improved integral static shield of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a perspective view, with portions broken away, of a portion of a vacuum cleaner structure embodying the invention;

FIG. 2 is a fragmentary enlarged side elevation thereof;

FIG. 3 is an end view of the plug retainer mounted to the distal end of the wand, and with the plug mounted therein;

FIG. 4 is a fragmentary side elevation thereof; and

FIG. 5 is a fragmentary enlarged diametric section illustrating the connection of the connector elements mounted to the wand and handle, respectively.

BEST MODE FOR CARRYING OUT THE INVENTION

In the illustrative embodiment of the invention as disclosed in the drawing, a vacuum cleaner structure generally designated 10 is shown to include a floor sweeping nozzle 11 having a rotary brush 12 driven by an electric motor 13. Suction is applied to the underside of the nozzle through a wand 14 connected through a suction hose 15 to a source of suction, such as a canister (not shown).

Electrical power is provided to the motor 12 through a power cord 16 carried by the wand and terminating in its upper end in a connector 17, illustratively comprising a male terminal plug.

The male plug is disconnectably connected to a female plug 18 mounted to a handle portion 19 of the hose 15. The handle 19 includes control means 20 which, in the illustrated embodiment, comprises microprocessor control means. The control further includes control button portions 21 for selective engagement by the user's fingers in effecting selective operation of the vacuum cleaner.

As discussed above, electrostatic discharges have been found to occur in such apparatus, tending to provide spurious signals in the microprocessor control. The present invention comprehends the provision of means for effectively precluding the discharge of the electrostatic charge to the electrical conductors and connectors adjacent the connection of the wand to the handle, so as to effectively avoid such spurious signals.

More specifically, the invention comprehends the provision of an improved plug retainer generally designated 22 for mounting the male plug 17 to the upper end 23*a* of wand 23.

The plug retainer includes a segmentally cylindrical mounting portion 24 facially engaging wand end 23 subjacent a distal edge portion 25 of the wand end. The mounting portion includes an upstanding cord grip 26 adapted to removably receive and retain the power cord 16 adjacent plug 17.

The mounting portion further includes an upstanding shoulder portion 27 against which a distal end 28 of plug 17 abuts to retain the plug against longitudinal displacement from the retainer.

The opposite distal end portion 29 of the plug 17 is received in a generally tubular end portion 30 of the retainer effectively cantilevered from the mounting portion 24, as best seen in FIG. 2. As further illustrated in FIG. 3, end portion 30 includes a radially outer, arcuate portion 31 and a planar, inner wall portion 32 defining therebetween a plug end receiving space 33.

Wall 32 is formed unitarily integral with the mounting portion 24 to extend longitudinally therefrom substantially toward the distal end 34 of the outer portion 31 sufficiently to extend to beyond the distal ends 35 of the projecting male terminals 36 of the male plug 17 when the male plug is installed on the plug retainer 22.

Wall 32 defines a static shield effectively precluding static electricity discharge from the wand to the electrical conductor means of the plugs 17 and 18 and associated cords. As the static shield 32 is unitarily continuous with the mounting portion 24, no gap occurs between the static shield wall 32 and the mounting portion 24 of the plug retainer, thereby providing improved prevention of static energy discharge to the electrical conductors.

Wall 32 extends fully across space 33, as best seen in FIGS. 3 and 4, and is formed unitarily integral with the wall 31, so that, again, no leakage path is permitted around the side edges of the wall to the electrical conductors.

The plug retainer 22 is secured to the wand end 23 by suitable means, such as rivets 37. Handle portion 19 includes a tubular distal portion 38 adapted to slidably fit into the distal end 23 of the wand and, resultingly, bring the female plug 18 into electrically connected association with the projecting terminals 36 of plug 17 mounted in the retainer 22. Handle end 38 is provided with a resiliently, outwardly biased locking button 39 adapted to be removably received in an opening 40 in wand end 23 subjacent an outwardly enlarged guide portion 41 thereof. When the tubular portion 38 is fully received within the wand end 23, the female plug 18 is disposed in full electrical connected association with the male plug 17, as illustrated in FIG. 5.

Tubular portion 38 is further provided with an arcuate opening 42 having an arcuately adjustable cover 43 for varying the amount of exposure of the opening 42 to the ambient atmosphere. During operation of the vacuum cleaner, the adjustable positioning of the cover 43 provides for adjusted control of the amount of suction being provided through the nozzle 11, as desired by the user. As shown in FIG. 5, when the handle is fully connected to the wand end 23, opening 42 is aligned with the baffle wall 32.

Shoulder portion 27 of the male plug retainer 22 retains the male plug against longitudinal displacement as the female plug is brought into electrical connected association therewith, as best seen with reference to FIGS. 2 and 5.

In addition to the rivets 37, the male plug retainer 22 is retained to the wand end portion 23 by a locking tongue 44, which, as shown in FIG. 5, is received in a recessed portion 45 at the distal edge 25 of the wand end 23 opposite the recessed guide portion 41 thereof. Thus, the locking tongue embraces the distal edge portion for securing the male plug retainer against displacement radially of the wand end away from the edge portion, i.e. transversely to the longitudinal extend of the wand end.

As best seen in FIG. 2, the plug 17 is spaced outwardly from the wand end 23 by a spacer portion 45 of the plug retainer. Such spaced disposition further minimizes the possibility of electrostatic discharge to the conductors and plug.

In use, power is provided to the microprocessor control means 20 through wires 46 carried by hose 15, connected to a canister (not shown) having a power cord. The wires 46, three in number in the disclosed embodiment, are connected through handle 19 and control means 20 to female plug 18 which receives the terminal 36 of plug 17. The center terminal 36*b*, which transmits signals to the microprocessor of control means 20, is shorter than the outside terminals 36*a* and 36*c* employed for power transmission, to provide a desired spacing for terminal ends 35 in the electrical connection of plugs 17 and 18.

Power is transferred from plug 18 to plug 17 and cord 16 to the nozzle motor 13. Discharge of electrostatic energy from the wand and handle portion 38 to the terminals at the connection between plug 18 and plug 17 is effectively prevented by the novel baffle wall 32 formed integrally with the plug retainer portion 31. The use of the locking tongue 44 provides improved retention of the male plug retainer 22 to the wand end for facilitated automatic connection of the female plug 18 to the male plug 17.

Thus, the plug retainer structure of the present invention provides improved static shielding effectively avoiding spurious operation of the control 20 from undesirable electrostatic discharges to the control wiring. The plug retainer provides an integral static shield and means for accurately spacing the plug from the wand end without the need for additional separate mechanical securing means. The plug retainer provides improved spacing of the male plug from the metallic wand end for further improved prevention of static discharge to the conductors and plug.

The foregoing disclosure of specific embodiments is illustrative of the broad inventive concepts comprehended by the invention.

I claim:

1. In a vacuum cleaner having metallic duct means defining a suction flow passage for conducting dirt laden air in the operation of the vacuum cleaner, and electrical circuit means for controlling operation of the vacuum cleaner including first and second electrical connectors having confronting surfaces and electrical terminals exposed at said surfaces, the improvement comprising:

first mounting means removably mounting said first connector to said duct means; and second mounting means mounting said second connector to said duct means with said electrical terminals being spaced outwardly of said duct means and being electrically connected at a joint between said confronting surfaces capable of passing static electricity outwardly from said duct means to said terminals, said second mounting means including a static shield unitarily integral therewith interposed between said connector confronting surfaces joint and said duct means to comprise means for preventing static electricity from passing outwardly from said duct to said terminals through said joint.

2. The vacuum cleaner structure of claim 1 wherein said duct means defines an annular distal end portion and said second mounting means includes unitarily integral locking means embracing said end portion.

3. The vacuum cleanser structure of claim 1 wherein said second mounting means comprises a one-piece element including a duct-engaging portion secured in facial engagement with said duct means, a connector-supporting portion, and a spacer portion arranged to space said connector-supporting portion from said duct means.

4. In a vacuum cleaner having a first duct element having a first end, a second duct element having a second end selectively connected to said first duct element first end to define therewith a suction flow passage for conducting dirt laden air in the operation of the vacuum cleaner, first conductor means carried by said first duct element for conducting electrical power including a first connector, first mounting means for mounting said first connector to said first duct element adjacent said first end, and second conductor means carried by said second duct element for conducting electrical power including a second connector, the improvement comprising second mounting means for removably mounting said second connector to said second duct element spaced outwardly from and adjacent said second end causing electrical connection between said first and second conductor means at a joint between said connectors capable of passing static electricity outwardly from said duct to the conductors when said first duct element end is connected to said second duct element, said second mounting means comprising a one-piece element having a housing portion defining a space for removably receiving said second connector, and a barrier wall portion integral with said one-piece element defining a static shield interposed between said space and said second duct element end for effectively preventing static electricity developed by dirt laden air flowing through said flow passage from affecting said electrical conductors at said electrical connection between said conductors.

5. The vacuum cleaner structure of claim 4 wherein one of said duct ends includes an opening therethrough for admitting ambient air into said flow passage.

6. The vacuum cleaner structure of claim 4 wherein said duct ends are formed of metal.

7. The vacuum cleaner structure of claim 4 wherein said wall portion extends fully transversely across said space.

8. In a vacuum cleaner having metallic duct means defining a suction flow passage for conducting dirt laden air in the operation of the vacuum cleaner, and electrical circuit means for controlling operation of the vacuum cleaner including first and second electrical connectors having confronting surfaces and electrical terminals exposed at said surfaces, the improvement comprising:

first mounting means removably mounting said first connector to said duct means; and second mounting means mounting said second connector to said duct means with said electrical terminals being spaced outwardly of said duct means and being electrically connected at a joint between said confronting surfaces capable of passing static electricity outwardly from said duct means to said terminals, said second mounting means including a static shield unitarily integral therewith interposed between said connector confronting surfaces joint and said duct means to comprise means for preventing static electricity from passing outwardly from said duct to said terminals through said joint, said wall portion including a front portion extending fully transversely across said space and a distal portion extending less than fully transversely across said space.

9. The vacuum cleaner structure of claim 8 wherein said second connector includes distal exposed electrical terminals and said wall portion distal portion extends intermediate said terminal and said second duct end when said second duct end is connected to said first duct end.

10. In a vacuum cleaner having metallic duct means defining a suction flow passage for conducting dirt laden air in the operation of the vacuum cleaner, and electrical circuit means for controlling operation of the vacuum cleaner including first and second electrical connectors having confronting surfaces and electrical terminals exposed at said surfaces, the improvement comprising:

first mounting means removably mounting said first connector to said duct means; and second mounting means mounting said second connector to said duct means with said electrical terminals being spaced outwardly of said duct means and being electrically connected at a joint between said confronting surfaces capable of passing static electricity outwardly from said duct means to said terminals, said second mounting means including a static shield unitarily integral therewith interposed between said connector confronting surfaces joint and said duct means to comprise means for preventing static electricity from passing outwardly from said duct to said terminals through said joint, said second duct end defining a longitudinal extent and a longitudinally distal edge portion, and said one-piece element further including an integral locking tongue portion embracing said distal edge portion for securing said element to said distal edge portion against displacement away from said distal edge portion transverse to said longitudinal extent.

11. The vacuum cleaner structure of claim 4 wherein said one piece element includes a support portion engaging said second duct end, a connector support wall, and means for spacing the connector support wall and said barrier wall from said second duct element end.

12. In a vacuum cleaner having a wand having an end, a suction hose having an end connector selectively connected to said wand end to define therewith a suction flow passage for conducting dirt laden air in the operation of the vacuum cleaner, a first power cord carried by said hose for conducting electrical power including a first terminal element carried by said wand end, and a second power cord carried by said hose for conducting electrical power including second terminal element, the improvement comprising mounting means for mounting said second terminal element to said wand to be spaced outwardly from said wand end for causing electrical connection between said first and second terminal elements at a joint between said hose end and wand end capable of passing static electricity outwardly therefrom to said terminal elements when said hose end is connected to said wand end, said mounting means comprising a one-piece support element having a housing portion defining a space for removably receiving said second terminal element, and a barrier wall portion integral with said one-piece element defining a static shield interposed between said space and said wand end for effectively preventing static electricity developed by dirt laden air flowing through said air flow passage from passing outwardly through said joint and thereby affecting said electrical terminals at said electrical connection between said terminal elements.

13. The vacuum cleaner structure of claim 12 wherein said first terminal element comprises a female terminal element and said second terminal element comprises a male terminal element.

14. The vacuum cleaner structure of claim 12 wherein said first terminal element comprises a female terminal element and said second terminal element comprise a male terminal element, and said one-piece element includes a guide means for guiding the male terminal element into electrical connected association with said female terminal element as an incident of connection of said wand end to said suction hose end.

15. The vacuum cleaner structure of claim 12 wherein said support element includes means for spacing said male terminal element from said wand end.

* * * * *